US011142366B2

(12) United States Patent
Renkert et al.

(10) Patent No.: US 11,142,366 B2
(45) Date of Patent: Oct. 12, 2021

(54) ADHESIVE TAPE DISPENSER WITH PUNCTURING BLADE

(71) Applicants: Michael F. Renkert, Port Orchard, WA (US); Kevin G. Shumway, Port Orchard, WA (US)

(72) Inventors: Michael F. Renkert, Port Orchard, WA (US); Kevin G. Shumway, Port Orchard, WA (US)

(73) Assignee: BLUTAPER, LLC, Port Orchard, WA (US)

( * ) Notice: Subject to any disclaimer, the term of this patent is extended or adjusted under 35 U.S.C. 154(b) by 0 days.

(21) Appl. No.: 16/168,604

(22) Filed: Oct. 23, 2018

(65) Prior Publication Data

US 2020/0122881 A1 Apr. 23, 2020

(51) Int. Cl.

| | |
|---|---|
| ***B65D 5/70*** | (2006.01) |
| ***B65H 35/00*** | (2006.01) |
| *B65D 5/74* | (2006.01) |

(52) U.S. Cl.

CPC ..... *B65D 5/708* (2013.01); *B65H 35/0033* (2013.01); *B65D 5/74* (2013.01); *B65H 35/004* (2013.01); *B65H 35/0026* (2013.01)

(58) Field of Classification Search

CPC ..... B65D 5/708; B65D 5/74; B65H 35/0033; B65H 35/004; B65H 35/0026

USPC ..... 225/51

See application file for complete search history.

(56) References Cited

U.S. PATENT DOCUMENTS

| | | | | |
|---|---|---|---|---|
| 2,473,072 | A * | 6/1949 | Plouff | A01K 89/00 83/610 |
| 2,817,404 | A * | 12/1957 | Vogt | B65H 35/0026 225/51 |
| 3,125,263 | A | 3/1964 | Harbour | |
| 3,743,150 | A * | 7/1973 | Eckart, Jr. | B05B 12/24 225/9 |
| 3,785,901 | A * | 1/1974 | Fritzinger | B65H 35/0033 156/527 |
| 3,895,059 | A * | 7/1975 | Link | B65H 35/0033 156/527 |
| 4,824,427 | A * | 4/1989 | Smillie, III | B65H 35/0026 225/25 |
| 5,269,871 | A * | 12/1993 | Longworth | B65H 35/0033 156/527 |
| 6,053,233 | A * | 4/2000 | Lin | B65H 35/0033 156/523 |
| 6,896,025 | B2 * | 5/2005 | Urushizaki | B65H 35/0033 156/523 |
| 8,820,382 | B1 | 9/2014 | Renkert | |
| 8,932,052 | B2 * | 1/2015 | Maki | A61C 7/306 433/3 |
| 10,294,061 | B1 * | 5/2019 | Renkert | B65H 35/0026 |
| 2012/0061026 | A1 * | 3/2012 | Lu | A47L 25/005 156/510 |

(Continued)

FOREIGN PATENT DOCUMENTS

KR 100968436 B1 7/2010

*Primary Examiner* — Omar Flores Sanchez

(74) *Attorney, Agent, or Firm* — Galvin Patent Law LLC; Brian R. Galvin; Brian S. Boon

(57) ABSTRACT

An adhesive tape dispensing device having a narrow top portion with an opening, across which opening the tape is tensioned, and a blade that cuts the tape by first puncturing it and then proceeding to cut across the remainder of the tape.

7 Claims, 7 Drawing Sheets

(56) References Cited

U.S. PATENT DOCUMENTS

| | | | | |
|---|---|---|---|---|
| 2014/0263528 | A1* | 9/2014 | Ormerod | B65H 35/0026 225/77 |
| 2015/0266692 | A1* | 9/2015 | Tiedemann | B65H 37/005 156/577 |

* cited by examiner

100

ADHESIVE TAPE DISPENSER WITH PUNCTURING BLADE

CROSS-REFERENCE TO RELATED APPLICATIONS

None.

BACKGROUND OF THE INVENTION

Field of the Art

The disclosure relates to the field of adhesive tape dispensers, and more particularly to a adhesive tape dispenser with puncturing blade.

Discussion of the State of the Art

In the field of painting, precision is a necessity for painters. Trim work in housing and other types of buildings needs to be covered during the process of painting walls, while the corners and edges of walls and ceilings need to be covered when more than one color is used. Crisp lines, colors not running together, precision corner cutting for tape, and paints not being mixed are all part of the precision techniques of painting. Caulking is also a precision skill; areas next to those that are being caulked need to be covered so that they are not accidentally caulked as well.

Painters often use an adhesive in the form of a strip (such as tape) to cover trims, corners, edges, and other parts that need protection from the paint and caulking process. Painters also use adhesive tapes as a form of stenciling when tasked with painting designs and patterns. Existing adhesive tape dispensers are awkward in tight spaces, require measurement and a separate cutting implement for precision, don't cut tape or assist with ancillary tasks for tape, paint, and caulking purposes, and are slow to use. Some dispensers provide a stationary serrated edge cutting mechanism, which requires movement and manipulation of either the tape or the dispenser, resulting in misplaced tape, torn or wrinkled tape, or an inaccurate cut. Other dispensers often require the painter to sever the adhesive tape with a separate device, such as scissors or a knife. These devices require the painter to measure or estimate the surface in need of the adhesive first, then pull the adhesive to the desired length before severing it from the dispenser, and then applying the adhesive to the surface. Adhesive can curl in on itself or stick to other surfaces while painter is severing it and trying to apply it to the desired surface. This makes applying adhesive cumbersome and severing the adhesive from the dispenser is also cumbersome and can cause poor quality tape application, and can lead painters to become very frustrated.

What is needed, then, is a means to provide an adhesive tape dispensing device with a puncturing blade within the device for the purposes of preventing tape compression as with a from-the-side cutting approach, so that greater precision is achieved without a painter needing to measure or carry a separate device for severing the adhesive form the device, as well as providing greater ease of use and speeding up application times.

SUMMARY OF THE INVENTION

Accordingly, the inventor has conceived and reduced to practice, in a preferred embodiment of the invention, an adhesive tape dispenser with a puncturing blade. The following non-limiting summary of the invention is provided for clarity, and should be construed consistently with embodiments described in the detailed description below.

According to a preferred embodiment, an adhesive tape dispensing device with a puncturing cutter is disclosed, comprising: a body formed from a rigid material or materials, configured to hold and dispense adhesive tape, and having opening across which the adhesive tape is tensioned during use; and a blade mounted proximal to the opening, configured to cut the adhesive tape by first puncturing through the adhesive tape near the edge and then proceeding to cut across the remainder of the adhesive tape.

According to an aspect of an embodiment, the tip of the puncturing blade is sharpened, but the remainder of the cutting surface is not sharpened.

According to an aspect of an embodiment, the device is configured to hold a roll of adhesive tape.

According to an aspect of an embodiment, the device further comprises at least one spring configured to press against the side of the roll of adhesive tape, keeping the tape in the proper alignment for dispensing.

According to an aspect of an embodiment, the at least one spring is a leaf spring.

According to an aspect of an embodiment, the at least one leaf spring is molded or formed from the body of the device.

According to an aspect of an embodiment, the at least one leaf spring further comprises a nodular tip.

According to an aspect of an embodiment, the blade is configured to be movable to accommodate different widths of adhesive tape.

BRIEF DESCRIPTION OF THE DRAWING FIGURES

The accompanying drawings illustrate several aspects and, together with the description, serve to explain the principles of the invention according to the aspects. It will be appreciated by one skilled in the art that the particular arrangements illustrated in the drawings are merely exemplary, and are not to be considered as limiting of the scope of the invention or the claims herein in any way.

DETAILED DESCRIPTION

Definitions

The term "adhesive tape" refers to any one of a variety of combinations of backing materials coated with an adhesive, typically in the form of a ribbon or strip. Different backing materials and adhesives can be used depending on the intended use, and the width of the tape can vary, depending on the application.

The term "spring" as used herein means any spring-like device or material to which force may be applied in one direction, and which tends to resist that force by pushing back against it. In one aspect of an embodiment, a spring may be a wound metal wire, but in other embodiments, a spring may be of different forms and different materials. For example, a spring may be flexible, flat piece of metal, or a tab molded into the body of the device.

Detailed Description of Exemplary Embodiments

It is important to note that adhesive tape is flexible, and tends to resist cutting from the side. A blade approaching from the side of the tape will tend to fold or bunch the edge of the tape instead of cutting cleanly, even where the blade is sharp. However, a blade with a sharp tip that punctures the adhesive tape prior to cutting across the tape will cut cleanly, even with a blade that is relatively dull.

Figure 1:
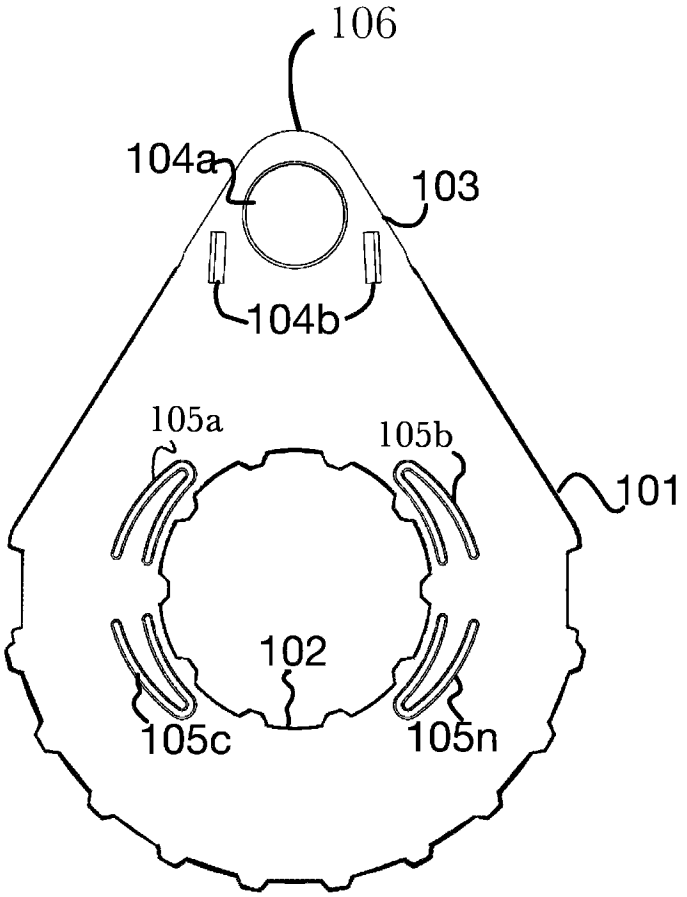
FIG. 1 is an illustration of an exemplary adhesive tape dispenser according to a preferred embodiment of the invention, illustrating a top side view of device design.

FIG. 1 is an illustration of an exemplary adhesive tape dispenser according to a preferred embodiment of the invention, illustrating a top side view 100 of device design.

According to the embodiment, adhesive tape dispenser 100 may comprise a generally bisected lachrymiform body 101 with a circular center 102 cut out of the middle of the first width bottom portion of lachrymiform shape 101, for springs to be molded (either directly into underside of lachrymiform shape 101 or attached to—as in not built in directly to dispenser 100—to the underside of lachrymiform shape 101) to gently push tape up against a wall, with which the device may be held up against during use (generally, a bisected lachrymiform shape to be assembled as illustrated; however, it should be appreciated that other final shapes may be used according to a desired arrangement or use case, such as an oblong shape or a rectangular shape, or other arrangement); one must having solid walls 101 formed of a rigid material such as metal or plastic, where one end tapers to a smaller second width 103 with a circular shape 104*a* cut out along with two uniform rectangular shapes 104*b* cut out for puncturing blade to assemble to device; and also having a plurality of uniform shapes cut out 105*a-n* around center 102 for holding adhesive tape core in place while dispenser is in use.

Figure 2:
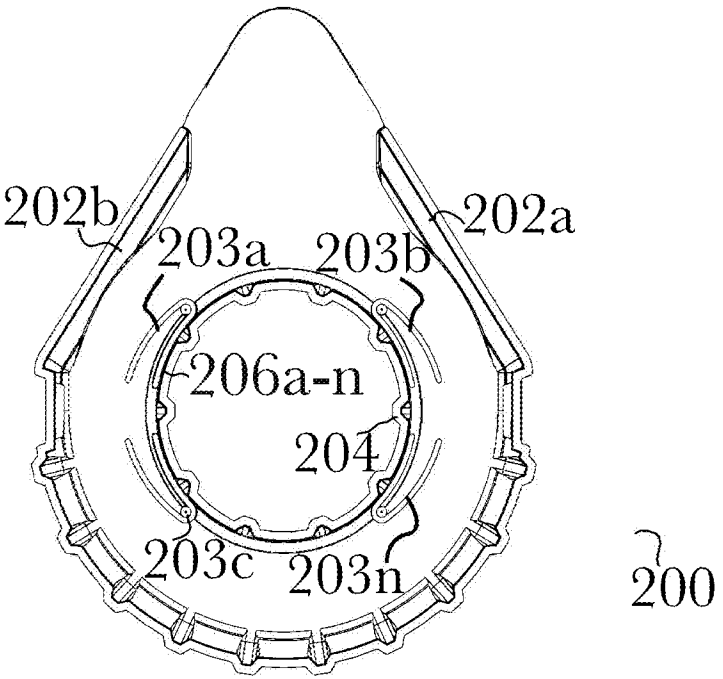
FIG. 2 is an illustration of an exemplary adhesive tape dispenser according to a preferred embodiment of the invention, illustrating a bottom side view of device design.

FIG. 2 is an illustration of an exemplary adhesive tape dispenser according to a preferred embodiment of the invention, illustrating a bottom side view 200 of device design. According to the embodiment, adhesive tape dispenser 201 has two or more springs 202*a*, 202*b* to apply light pressure to a roll of tape, such that the device may be used up against another surface such as a wall to allow for uniform tape dispensed across a straight surface, the springs 202*a*, 202*b* keeping the tape stable up against a surface, while a cutting knife may cut it when desired 402. Cut-outs 105*a-n* are cut around a plurality of stationary lever arms 203*a-n* that each have a rounded nodule at their tip, for holding core of adhesive tape in place when in use. Circular center 102, 206*a-n* has indentations 204 where springs are built-in or affixed, to hold adhesive tape in place.

Figure 3:
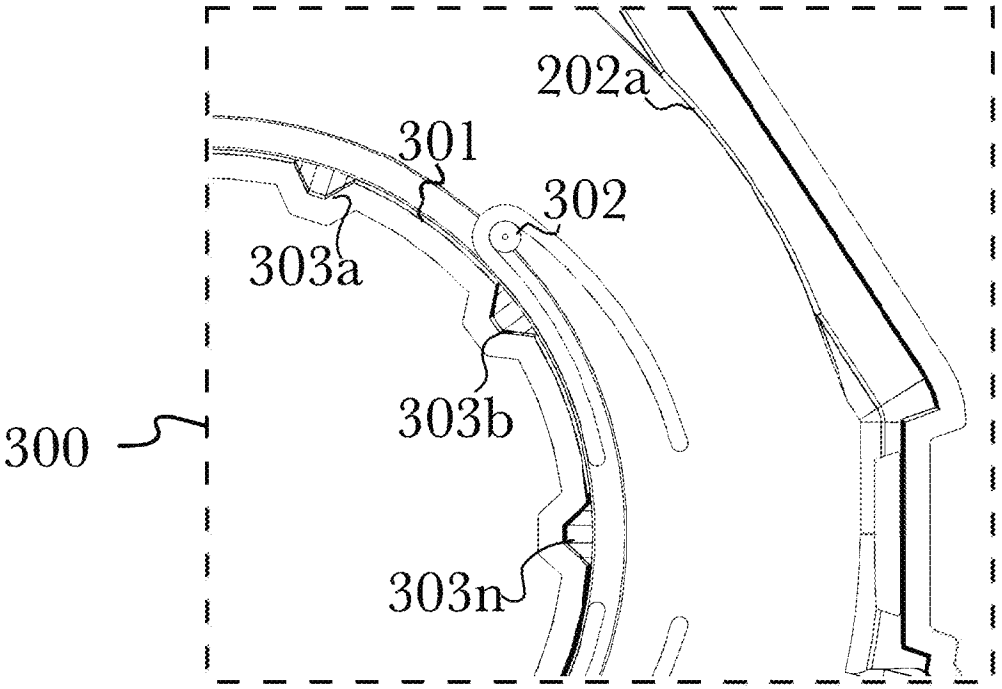
FIG. 3 is an illustration of an exemplary underside close up view of adhesive tape dispenser according to a preferred embodiment of the invention, illustrating where springs and strip adhesive assemble to device.

FIG. 3 is an illustration of an exemplary underside close-up view of adhesive tape dispenser according to a preferred embodiment of the invention, illustrating where springs and adhesive tape assemble 300 to device 100. Adhesive tape rests between bumper 202*a* and center wall 301, while core of strip adhesive (the object adhesive tape is wound about; core material may be cardboard or plastic) will connect to stationary lever arm nodule tip 302 for added flow consistency of adhesive tape as adhesive is pulled from dispenser 100. Indentations 303*a-n* hold springs (springs used may be, but are not limited to: leaf springs, coiled springs, molded wave springs, or others, and may be permanently affixed to device 100 such as by welding or industrial adhesives, or temporarily affixed to device 100 according to a desired use case) that push against device 100 and a roll of adhesive tape, holding tape roll against wall of device 100 by applying a constant but slight pressure to adhesive tape.

Figure 4:
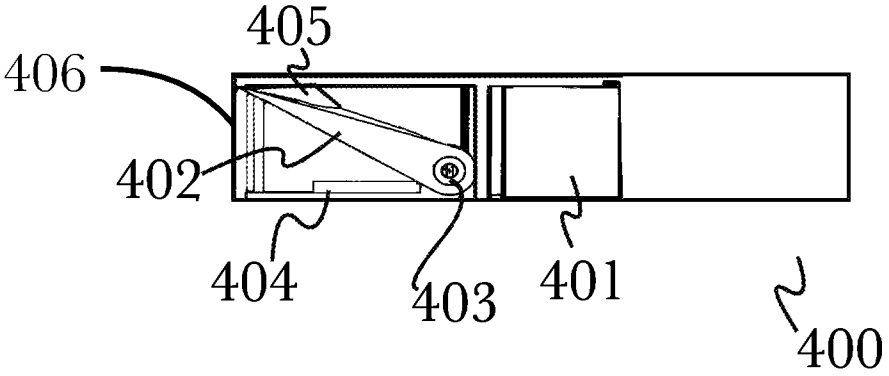
FIG. 4 is an illustration of an exemplary internal side view of adhesive tape dispenser according to a preferred embodiment of the invention, illustrating within device a blade for cutting adhesive tape.

FIG. 4 is an illustration of an exemplary internal side view of adhesive tape dispenser according to a preferred embodiment of the invention, illustrating within device 400 a blade for cutting adhesive tape. According to the embodiment, within device 400 above portion of device 401 for holding adhesive tape is blade 402 for severing adhesive tape. Blade 402 is thick at one end with a hollowed-out core for attaching to rotating pin 403. Blade 402 is secured in place partially by rotating pin 403 and by step levels 404; step levels 404 may be comprised of plastic or metal and have two levels (it should be appreciated that device may have more than two levels of step levels such as but not limited to one step, three steps, five steps, etc. according to a desired use case) for blade 402, with help of safety button 405 and rotating pin 403, to move blade 402 along step levels 404 to accommodate different widths of adhesive tapes which can vary. Safety button 405 attaches to device cut-out 104*a* and rests on blade 402. Safety button 405 keeps device users from injury by blocking cut-out 104*a* but also can be pushed down on blade 402 to adjust blade 402 on step level 404 for varying adhesive tape widths.

Figure 5:
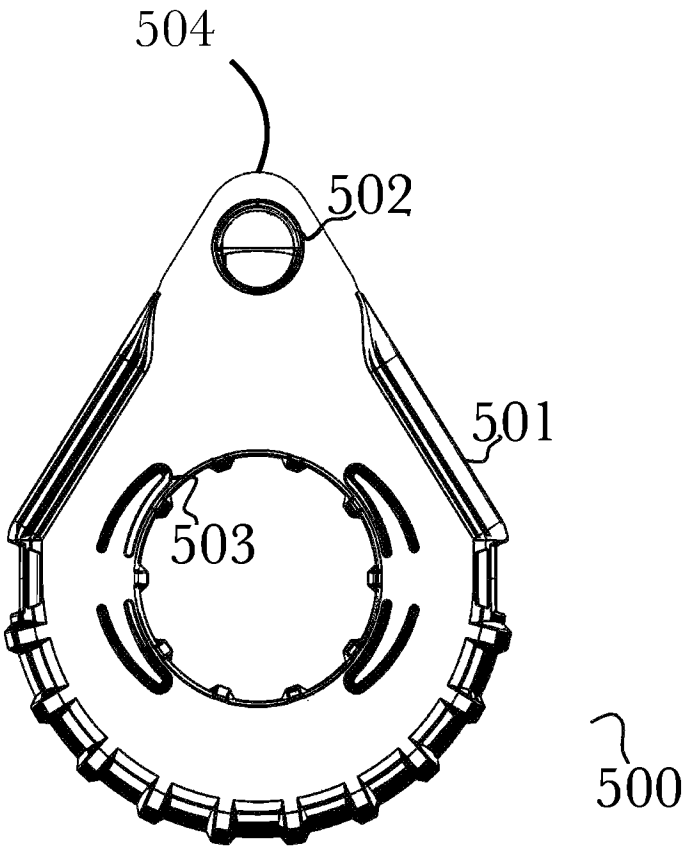
FIG. 5 is an illustration of an exemplary assembled adhesive tape dispenser according to a preferred embodiment of the invention, illustrating a top side view of device with blade and roll of adhesive tape assembled to device.

FIG. 5 is an illustration of an exemplary assembled adhesive tape dispenser according to a preferred embodiment of the invention, illustrating a top side view of device with blade and roll of adhesive tape assembled 500 to device. According to the embodiment, assembled device 500 comprises dispenser device 501 with blade assembly 502 attached to cut-outs 104*a*, 104*b* and safety button 405 visible from top view. Adhesive tape 503 can be seen through cut-outs 105*a-n* and attaches to the underside of device 500 by attaching adhesive 503 core to stationary lever arm nodule tips 302, while adhesive 503 rests between device walls 301 and bumpers 202*a*, 202*b*.

Figure 6:
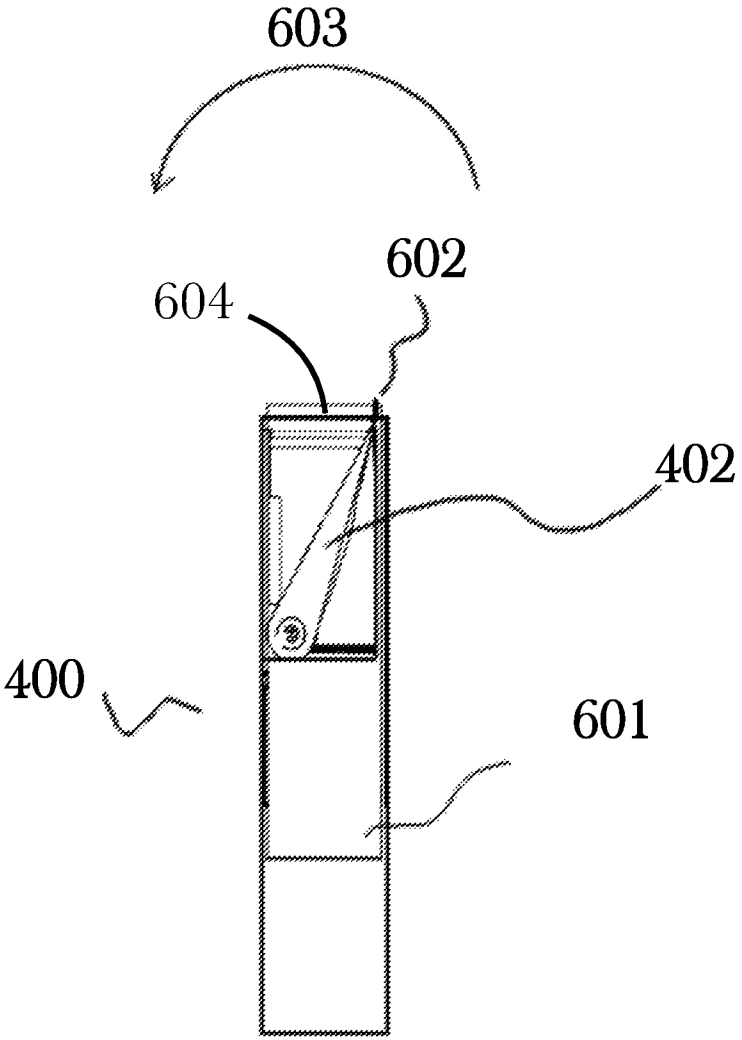
FIG. 6 is an illustration of an exemplary assembled adhesive tape dispenser according to a preferred embodiment of the invention, illustrating within device blade for cutting, adhesive tape held with tension around device, and motions taken by blade when cutting and dispensing adhesive tape.

FIG. 6 is an illustration of an exemplary assembled adhesive tape dispenser according to a preferred embodiment of the invention, illustrating within device 400; blade 402 for cutting, adhesive tape held with tension around device 601, and motions 603 taken by blade 402 when cutting and dispensing adhesive tape 601. Adhesive tapes, whose characteristics may vary greatly across different implementations of the instant invention, are held with tension on the end of the invention 601, allowing blade 402 to puncture 602 adhesive tape 601, allowing motion 603 to carry blade 402 across at least 80% of the length of the adhesive tape 601. Blade 402 must puncture 602 adhesive tape 601 before being moved across a significant amount of the length of adhesive tape 603, because if a blade does not first puncture 602 adhesive tape 601, blade 402 does not adequately or consistently cut adhesive tape 601.

Figure 7:
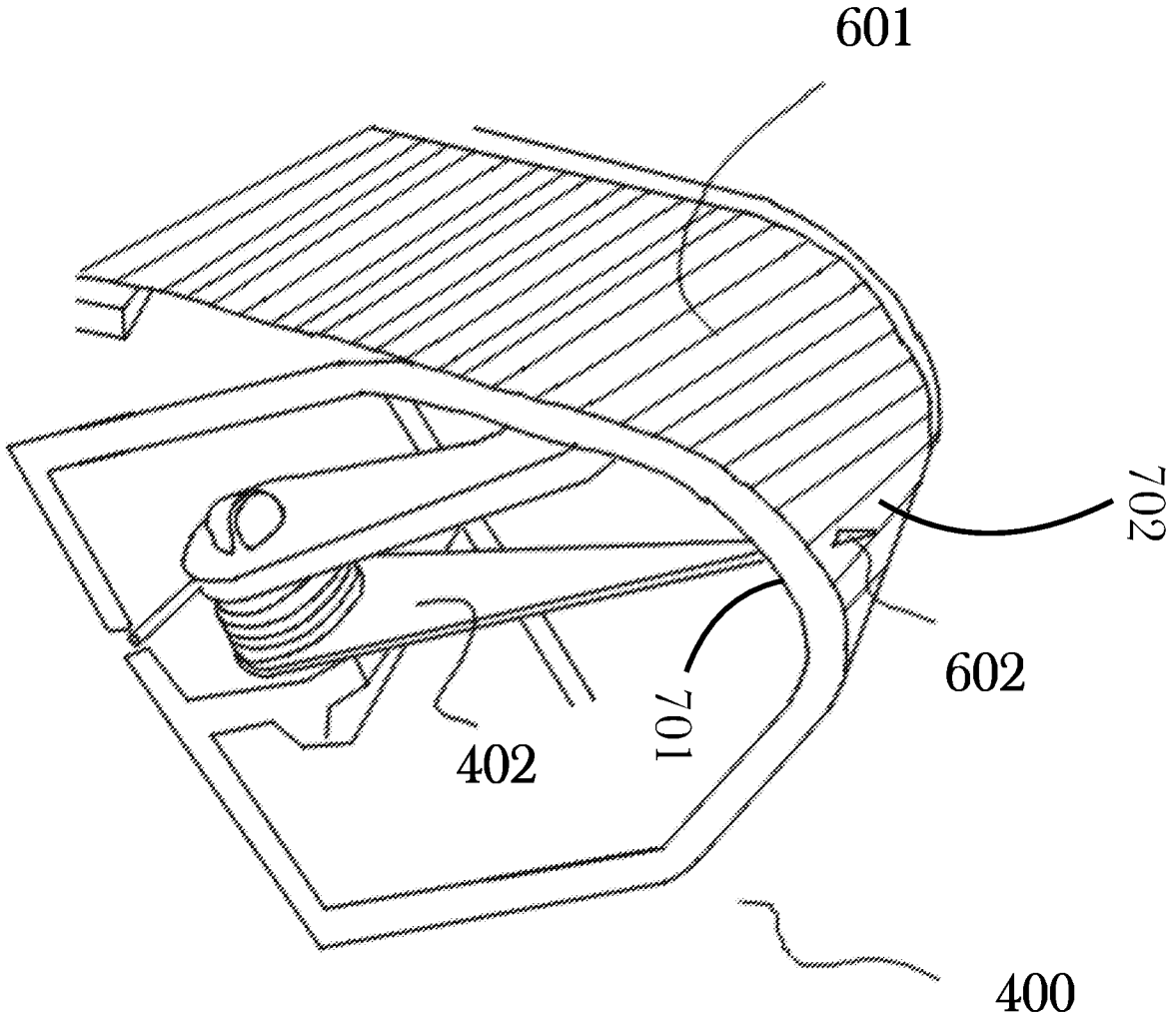
FIG. 7 is an illustration of an exemplary assembled adhesive tape dispenser viewed internally, according to a preferred embodiment of the invention, illustrating within device blade for cutting, and adhesive tape held with tension around device.

FIG. 7 is an illustration of an exemplary assembled adhesive tape dispenser viewed internally, according to a preferred embodiment of the invention, illustrating within device 400 blade 402 for cutting 603, and adhesive tape 601 held with tension around device 400. Shown in this figure is an exemplary blade 402 which may be made of any particular composition including common steel alloys, piercing 602 adhesive tape 601 which is held with tension around device 400. Tension is crucial in this embodiment, as blade 402 must puncture 602 adhesive tape 601 before attempting to cut it in a moving motion 603, in order to properly function.

In some embodiments, the cutter may be a triangular-shaped blade that moves linearly, puncturing the center of the tape, and proceeding to cut outward as the blade is pushed into the tape. In some embodiments, the cutter may be a dual blade The skilled person will be aware of a range of possible modifications of the various embodiments described above. Accordingly, the present invention is defined by the claims and their equivalents.

What is claimed is:

1. An adhesive tape dispensing device with a puncturing cutter, comprising:

a body formed from a rigid material or materials, configured to hold and dispense an adhesive tape, and having an opening across which the adhesive tape is tensioned during use, the opening having a first side across which the adhesive tape is tensioned and a second side opposite the first side; and at least one blade mounted on the second side of the opening, the blade having a tip and being configured such that the tip of the blade, when retracted, is located proximally to the second side of the opening;

wherein, when the blade is operated, the tip of the blade first punctures through the adhesive tape through the opening and then proceeds to cut across the adhesive tape.

2. The device of claim 1, wherein the tip of the puncturing blade is sharpened, but the remainder of the cutting surface is not sharpened.

3. The device of claim 1, wherein the device is configured to hold a roll of adhesive tape.

4. The device of claim 3, wherein the device further comprises at least one spring configured to keep the tape in the proper alignment for dispensing.

5. The device of claim 4, wherein the at least one spring is a leaf spring.

6. The device of claim 5, wherein the at least one leaf spring is molded or formed from the body of the device.

7. The device of claim 1, wherein the blade is configured to be movable to accommodate different widths of adhesive tape.

* * * * *